United States Patent [19]

Hartmannsgruber et al.

[11] Patent Number: 4,512,061

[45] Date of Patent: Apr. 23, 1985

[54] METHOD OF CONTROLLING FIBER-DRAWING APPARATUS

[75] Inventors: Max Hartmannsgruber, Kirchheim; Kurt Kriechbaum, Ingoldstadt; Günter Schulz, Ebersbach; Hermann Güttler, Uhingen, all of Fed. Rep. of Germany

[73] Assignee: Zinser Textilmaschinen GmbH, Ebersbach, Fed. Rep. of Germany

[21] Appl. No.: 600,310

[22] Filed: Apr. 13, 1984

Related U.S. Application Data

[60] Division of Ser. No. 420,787, Sep. 21, 1982, Pat. No. 4,473,924, which is a continuation-in-part of Ser. No. 196,582, Oct. 14, 1980, abandoned.

[30] Foreign Application Priority Data

Oct. 13, 1979 [DE] Fed. Rep. of Germany ..... 2941612

[51] Int. Cl.[3] ..... D01H 5/42

[52] U.S. Cl. ..... 19/239; 19/240; 19/293; 19/300; 364/470

[58] Field of Search ..... 19/236, 239, 240, 258, 19/260, 266, 270, 272, 276, 280, 281, 282, 293, 300; 364/470

[56] References Cited

U.S. PATENT DOCUMENTS 4,199,844 4/1980 Goetzinger ..... 19/240

FOREIGN PATENT DOCUMENTS 1443258 7/1976 United Kingdom ..... 19/240

*Primary Examiner*—Louis K. Rimrodt

*Attorney, Agent, or Firm*—Karl F. Ross; Herbert Dubno

[57] ABSTRACT

A draw frame of a sliver-drafting apparatus has three cascaded roller pairs whose lower rollers are driven by respective motors at speeds determined by associated frequency dividers and/or multipliers in the output of a common oscillator of adjustable operating frequency. The slivers drafted by the roller pairs form, after doubling or plying, a fiber bundle traversing a thickness sensor whose output, integrated over predetermined time periods, is used by a microcomputer to ascertain optimum nip-line spacings and contact pressures reducing the thickness variations to a minimum. These parameters can be varied by horizontal slides supporting the roller pairs and spring-loaded blocks acting upon the shafts of the upper rollers; the positions of the slides and the pressures of the loading springs are adjustable by servomotors, under the control of the microcomputer, on the basis of a running-in program in which different combinations of values for the spacings and the pressures are successively set up and the combinations yielding the highest degree of uniformity are subsequently re-established.

3 Claims, 5 Drawing Figures

METHOD OF CONTROLLING FIBER-DRAWING APPARATUS

CROSS-REFERENCE TO RELATED APPLICATION

This is a division of Ser. No. 420,787, filed 9-21-82 (now U.S. Pat. No. 4,473,924 issued Oct. 2, 1984) which is a continuation-in-part of our copending application Ser. No. 196,582 filed Oct. 14, 1980, now abandoned.

FIELD OF THE INVENTION

Our present invention relates to a fiber-drawing apparatus, such as a rolling mill including a draw frame for the drafting of card sliver, and more particularly to a method of controlling the operation thereof.

BACKGROUND OF THE INVENTION

A draw frame of the type referred to has been disclosed in commonly owned U.S. Pat. No. 4,314,388, for example. According to that prior patent, a plurality of cascaded drawing stages are constituted by respective roller pairs, each including a driven lower roller and a set of corotating counterrollers which may be regarded as a single upper roller. The lower rollers are rotated by synchronous motors at speeds determined by respective digital frequency selectors energized from a common source of three-phase current. Such frequency selectors are also disclosed in commonly owned U.S. Pat. No. 4,336,684.

When incoming card sliver to be doubled or plied in such a draw frame is combined into an outgoing fiber bundle, the latter often lacks the necessary uniformity until various changes have been made in the operating parameters which determine the tension imparted to the fibers and the resulting bulk or thickness of the outgoing bundle. Once the proper speed ratio has been established among the several roller pairs, the setting of the associated frequency selectors can be left unchanged upon a switchover to a different fiber assortment even if the absolute roller speeds are to be modified. The use of an optimum speed ratio, however, does not by itself eliminate thickness fluctuations of the resulting fiber bundle.

While speed ratios can be precalculated, other parameters affecting the uniformity of the fiber bundle can be optimized only by trial and error. These parameters include the effective spacing of the roller pairs from one another, referred to hereinafter as their nip-line distance, and the contact pressure exerted by the rollers of each pair upon the fibers clamped therebetween. Changing the nip-line distance modifies the tensile stress imparted to the fibers while a variation of the clamping force alters their compressive stress. Making such changes by hand, e.g. in an initial phase of a new fiber-drawing operation, is a laborious and time-consuming task.

OBJECT OF THE INVENTION

An important object of our present invention, therefore, is to provide a method of simplifying the preliminary adjustment of a draw frame preparatorily to the doubling or plying of any new fiber assortment for achieving the greatest possible uniformity of the resulting fiber bundle.

SUMMARY OF THE INVENTION

An apparatus according to our invention comprises stress-adjusting means coupled with rollers of the several cascaded pairs referred to which follow one another in the direction of travel of incoming fibers to be combined into an outgoing bundle. Thickness variations of that bundle are detected by sensing means disposed in its path downstream of the roller pairs. The extent of fluctuations of that thickness is determined by evaluation means connected to the sensing means, the apparatus further including control means responsive to output signals of the evaluation means for setting the stress-adjusting means in a position in which the extent of the fluctuations is at a minimum.

Advantageously, the control means comprises a microcomputer with a programmer which in an initial or running-in phase of a fiber-drawing operation establishes a succession of different settings of the stress-adjusting means for predetermined time periods in order to enable the evaluation means to register a mean value for the fluctuations encountered with each setting.

Thus, the method aspects of our invention basically comprise the steps of sensing thickness fluctuations of the outgoing bundle, successively adjusting at least one of the aforementioned tensile and compressive stresses to several different values, keeping each such value constant for a predetermined period while measuring the extent of these fluctuations, and thereafter maintaining the adjustable stress at a value for which the measured fluctuations are at a minimum, all this preferably in a programmed manner.

If the stress to be adjusted is the tension, whose magnitude depends primarily on the speed ratio of successive roller pairs but is also influenced by their nip-line distance, the adjustment step involves a relative displacement of these roller pairs. If, on the other hand, the compressive stress exerted by the clamping force is being taken into consideration, the adjustment step involves a variation of the contact pressure of one or more roller pairs.

The sensing of the thickness of the fiber bundle is advantageously carried out by a cup with a restricted outlet which is carried on a free end of a resiliently cantilevered arm so as to be limitedly deflectable by the frictional drag of that bundle. The extent of this deflection can be measured with a high degree of accuracy by a capacitive coupling of the arm with an associated transducer.

BRIEF DESCRIPTION OF THE DRAWING

The above and other features of our invention will now be described in detail with reference to the accompanying drawing in which.

SPECIFIC DESCRIPTION

Figure 1:
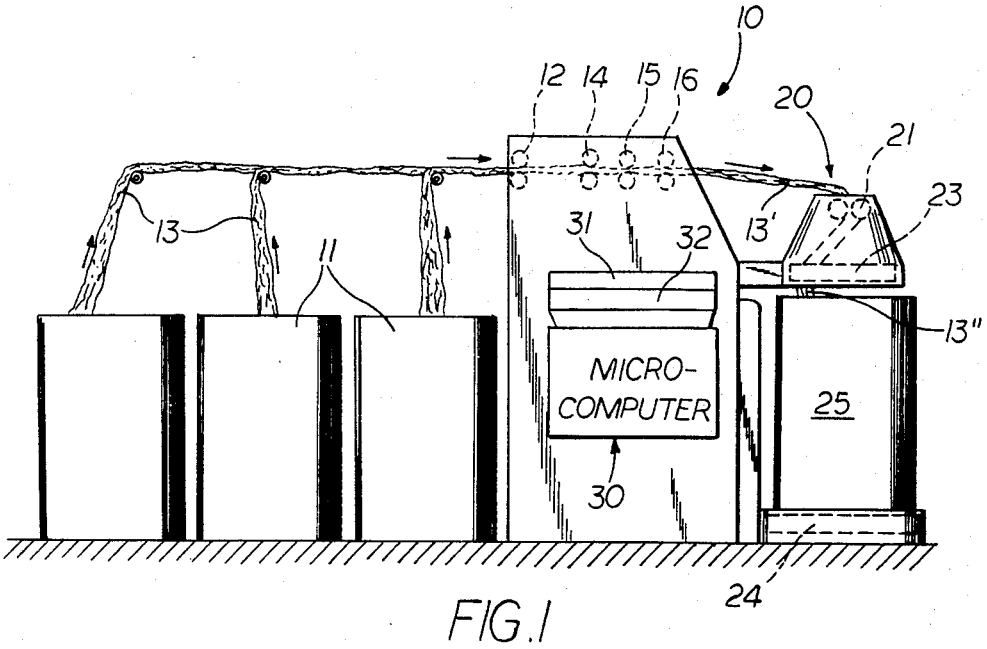
FIG. 1 is a somewhat diagrammatic side view of a fiber-drawing apparatus embodying our invention.
Figure 2:
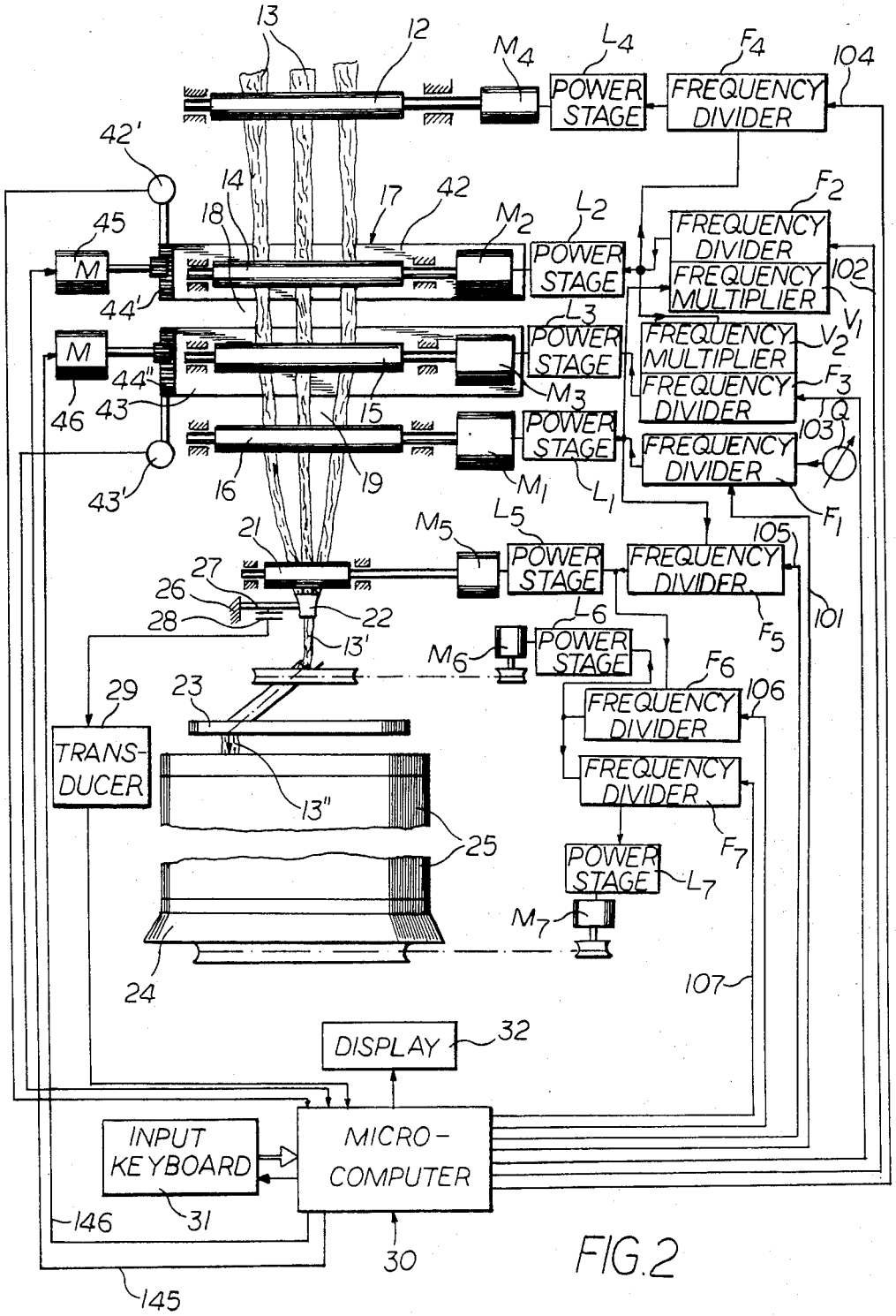
FIG. 2 is a top view of a draw frame and associated elements of the apparatus of FIG. 1 along with a block diagram of its electrical system.

The apparatus shown in FIGS. 1 and 2 comprises a draw frame 10 for cotton sliver 13 extracted from several—e.g. six—input cans 11 (only three shown) and advanced by a number of cascaded roller pairs 12, 14, 15 and 16 to a twisting stage where a resulting fiber bundle 13', into which the slivers 13 has been combined, is converted into a roving 13". Stage 20 includes a further roller pair 21 above a throw-off disk 23 depositing the roving 13" in a receiving can 25 supported by a turntable 24. Also shown in FIG. 1 is a microcomputer 30 controlling the operations of the several roller pairs, the throw-off disk and the turntable, as more fully described hereinafter.

As shown in FIG. 2, a thickness sensor 22 is interposed in the path of the outgoing fiber bundle 13' between roller pair 21 and throw-off disk 23. Sensor 22 comprises a cup with a restricted orifice at its downstream end, this cup being carried on the free end of a cantilevered arm 27 in the form of a leaf spring whose opposite end is fixedly mounted on a support 26. An intermediate part of leaf spring 27 is capacitively coupled, via a condenser 28, to a transducer 29 converting changes in the capacitance of this condendser into an electrical signal fed to microcomputer 30. Transducer 29 includes for this purpose a source of alternating current, connected across condenser 28, as well as an integrator connected across a resistor in series with that condenser.

The microcomputer may include a read-only memory, containing the invariable machine parameters, and a read/write memory to which data pertinent to a particular fiber-drawing operation can be supplied by means of a keyboard 31. These data, which can be visualized on a display screen 32, may relate to the number of incoming slivers 13 to be plied, the initial fineness of these slivers, the desired fineness of the roving to be produced therefrom and the overall drawing rate. From these data the microcomputer may calculate the necessary roller speeds, their contact pressure and the nip-line distances between successive roller pairs as well as the speeds to be imparted to disk 23 and turntable 24. On the basis of these determinations, whose results can also be visualized on the display screen 32, the microcomputer controls the operation of the apparatus.

Figure 4:
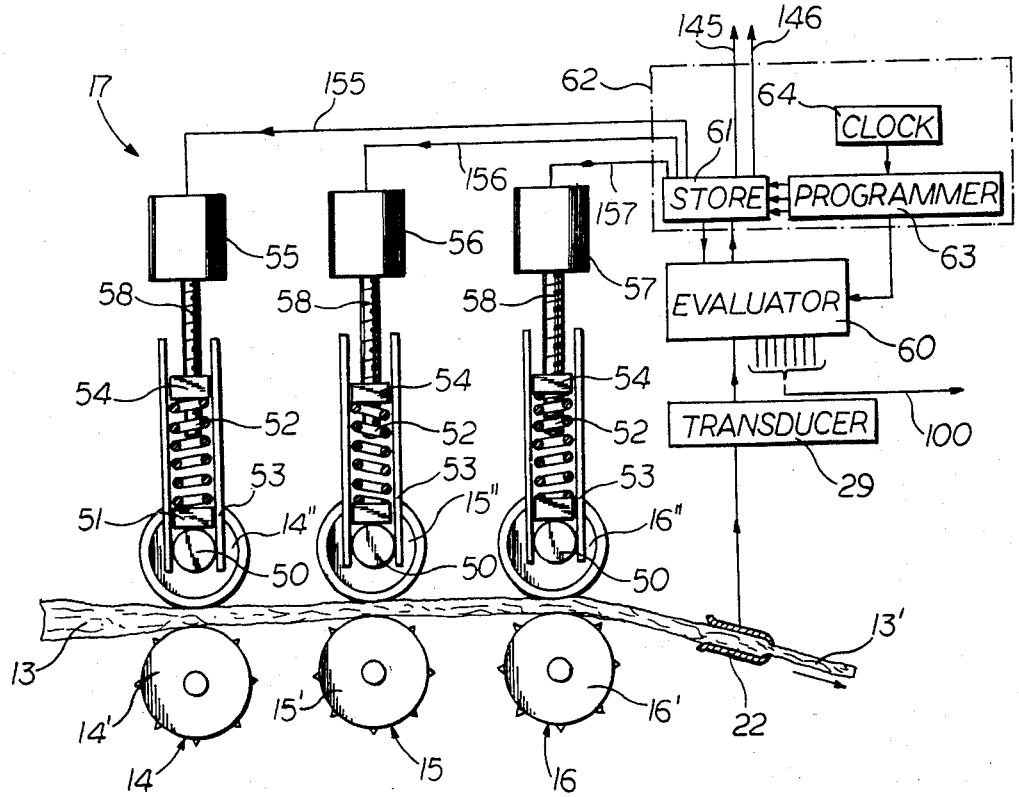
FIG. 4 is a side-elevational view of the draw frame, this FIGURE also showing some components of the electrical system in block form.
Figure 5:
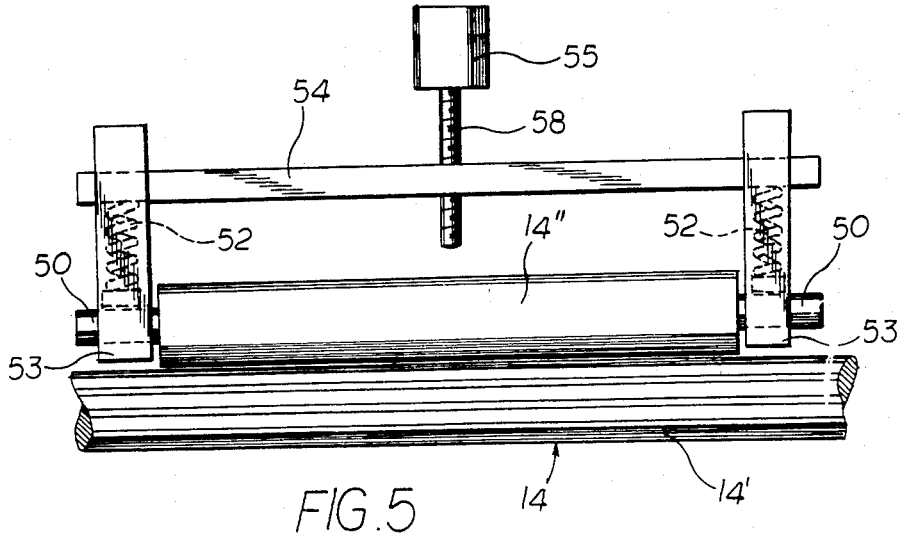
FIG. 5 is a rear-elevational view of the draw frame shown in FIG. 4.

Each fiber-drawing stage 12, 14, 15, 16 and 21 comprises a lower roller and an upper roller as particularly illustrated for stages 14, 15 and 16 in FIGS. 4 and 5 where the corresponding lower rollers have been designated 14', 15' and 16' while the upper rollers are labeled 14", 15" and 16". The lower rollers have ribs squeezing the entrained fibers against the upper rollers which are provided with peripheral jackets of elastic material; these upper rollers could be longitudinally subdivided, as in the earlier patents referred to, but have been shown unitary in the present instance.

The lower rollers of stages 12, 14, 15, 16 and 21 are driven by respective synchronous motors $M_4$, $M_2$, $M_3$, $M_1$ and $M_5$; another such motor $M_6$ drives the throw-off disk 23 whereas a further motor $M_7$ operates the turntable 24. While only a single motor has been shown for each lower roller, they could be duplicated at opposite ends thereof as taught in U.S. Pat. No. 4,314,388.

Roller pairs 14, 15 and 16 form part of a three-stage draw frame 17 imparting the main draft to the incoming slivers 13 which undergo preliminary tensioning in the stretch between roller pairs 12 and 14. The slivers are subjected only to a small tension on the outgoing stretch between roller pairs 16 and 21 before being combined into the bundle 13'. Roller pairs 14 and 15 are supported on respective slides 42 and 43 which are displaceable along the fiber path to vary the nip-line distances 18 and 19 between pairs 14, 15 and 15, 16. For this purpose the slides 42 and 43 are provided with respective racks 44', 44" in mesh with pinions on shafts of associated servomotors 45 and 46; again, these servomotors and the associated racks and pinions are advantageously duplicated at opposite ends of the slides for maintaining their proper orientation.

As shown in FIGS. 4 and 5, upper rollers 14", 15" and 16" have shafts 50 which are vertically guided between parallel plates 53 and are overlain by blocks 51 loaded by respective coil springs 52. The pressure of springs 52 is controlled by bars 54 each spacedly extending above a respective upper roller 14", 15", 16" with ends bracketed by the corresponding guide plates 53. Each bar 54 has a threaded bore engaged by a lead-screw 58 which constitutes the output shaft of an associated servomotor 55, 56 or 57. These servomotors can be reversibly driven by output signals of a microprocessor 62 which forms part of microcomputer 30 and includes a data store 61, a programmer 63 and a clock 64. Store 61 and programmer 63 are respsectively connected to an output and an input of an evaluator 60 receiving the output signals of transducer 29; evaluator 60 also has other output leads, collectively designated 100, extending to other components shown in FIG. 2. The commands for the operation of motors 55–57 are transmitted to them over leads 155–157 originating at data store 61.

A preferably adjustable master oscillator Q, FIG. 2, energizes the drive motor $M_1$ of the last lower roller 16' of draw frame 17 through a frequency divider $F_1$ and a power stage $L_1$. Frequency divider $F_1$ also feeds other frequency-modifying circuits, namely a frequency divider $F_5$ energizing drive motor $M_5$ through a power stage $L_5$ and a frequency multiplier $V_1$ in cascade with a frequency divider $F_2$ energizing drive motor $M_2$ through a power stage $L_2$. The output frequency of divider $F_2$ is also transmitted to a frequency divider $F_4$, energizing the motor $M_4$ through a power stage $L_4$, and to a frequency multiplier $V_2$ in cascade with a divider $F_3$ which energizes the motor $M_3$ through a power stage $L_3$. The output frequency of divider $F_5$ is also delivered to a further divider $F_6$ which energizes the motor $M_6$ and which also feeds a divider $F_7$ energizing the motor $M_7$ by way of a power stage $L_7$.

The step-down ratios of frequency dividers $F_1$–$F_7$ can be adjusted, under the control of microcomputer 30, by instruction words on respective leads 101–107 forming part of multiple 100 shown in FIG. 4. Another such lead, not shown, could be used to control the operating frequency of master oscillator Q. Further leads 145, 146, emanating from store 61 of FIG. 4, carry operating commands for servomotors 45 and 46, respectively. The positions of slides 42 and 43 are reported to the microcomputer by respective sensors 42' and 43'; similar sensors, not shown, feed back the positions of bars 54 of FIGS. 4 and 5.

Microcomputer 30 is thus able to vary both the relative and the absolute speeds of all lower rollers, of throw-off disk 23 and of turntable 24 on the basis of data fed in or calculated internally. In particular, the microcomputer may establish a certain speed ratio between roller pairs 12, 14, 15 and 16 consistent with the desired draft to be imparted to the fibers; this speed ratio will remain constant, in the absence of other instructions, if the operator varies the frequency of master oscillator Q (directly or by way of the microcomputer) to change the delivery rate of the apparatus. The same microcomputer may also control ancillary equipment, e.g. an exhaust system for a spinning-machine plant of which the apparatus forms part, for the purpose of regenerating a filter thereof in response to a drop in suction indicating excessive clogging; such an exhaust system is the subject matter of commonly owned application Ser. No. 261,631 filed May 7, 1981 by Walter Mollstätter, now patent No. 4,353,721 of Oct. 12, 1982.

Figure 3:
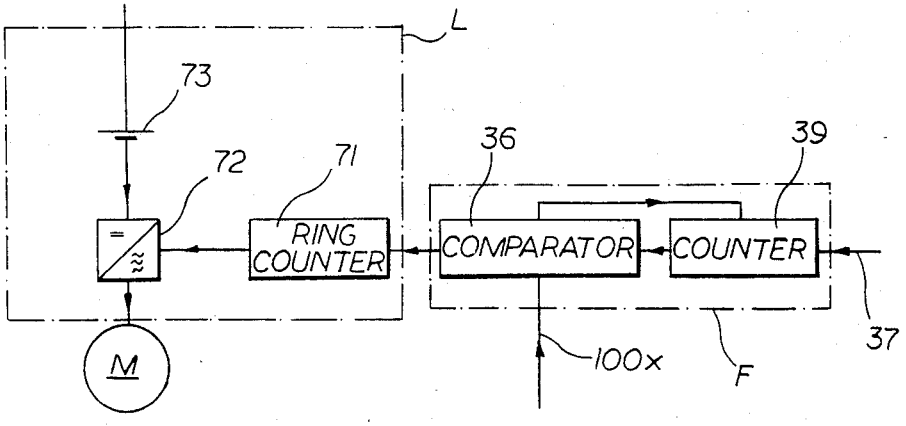
FIG. 3 is a more detailed block diagram of a frequency divider included in the system of FIG. 2.

In FIG. 3 we have shown, by way of example, details of a representative frequency divider F and power stage L associated with a generic motor M. Divider F comprises a pulse counter 39 receiving pulses from master oscillator Q (directly or via a preceding frequency multiplier or divider) on a lead 37 and transmitting its count to a comparator 36 which receives a word specifying a selected step-down ratio from microcomputer 30 on a conductor 100× representing the corresponding lead of multiple 100. This step-down ratio may, for example, be an integer ranging between 1 and 10,000. When counter 39 has reached the value of this step-down ratio, comparator 36 resets it and triggers a ring counter 71 in power stage L having six stages as described in the aforementioned U.S. Pat. Nos. 4,336,684 and 4,314,388. These stages control respective frequency inverters, collectively designated 72, which transform direct current from a source 73 into three-phase current driving the associated synchronous motor M.

Pursuant to an important feature of our present invention, programmer 63 can be activated (e.g. at the beginning of a fiber-drawing operation) to vary the loading pressure of rollers 14'', 15'', 16'' according to a predetermined routine while the evaluator 69 checks on the extent of thickness fluctuations of fiber bundle 13' as detected by sensor 22. Under the control of that programmer, evaluator 60 measures the depth of these fluctuations and averages them over an interval during which the setting of servomotors 55–57 is held constant. A binary word representing the setting of the three servomotors in any such interval is registered in an assigned cell of store 61 which also receives data from evaluator 60 pertaining to the mean fluctuation measured during the corresponding interval. At the end of that routine, as established by clock 64, programmer 63 directs the evaluator to find the lowest mean value registered in store 61 and to re-establish the setting of servomotors 55–57 corresponding to that value.

In an analogous manner, programmer 63 carries out a similar routine for the testing of the nip-line spacings 18 and 19 by causing an adjustment of servomotors 45 and 46 to different settings while a mean thickness fluctuation is determined by evaluator 60. Again, the setting of servomotors 45 and 46 is frozen in positions yielding the minimum thickness variation.

The two routines referred to can be executed in either order of succession. In each instance the programmer may, for example, change the setting of only one servomotor at a time and freezes that servomotor in its optimum position before similarly adjusting the remaining servomotor or servomotors.

In the foregoing description it has been assumed that the bars 54 of FIGS. 4 and 5 are shifted precisely parallel to themselves for a uniform variation of pressure across the entire fiber path. The single motor 55, 56 or 57 coupled with any loading bar 54 could be replaced by two motors with leadscrews engaging threaded bores near opposite ends of each bar to enable a controlled differential weighting thereof during execution of the running-in program described above, e.g. to accommodate slivers of unequal thickness passing simultaneously through the several drawing stages.

It is to be understood that the term "roller pair", as used herein, does not exclude the possible presence of an additional upper or lower roller in the same stage.

In some instances a sensor responsive to fiber thickness could be disposed ahead of some drawing stages, e.g. between roller pairs 14 and 15, to yield a useful result.

We claim:

1. A method of controlling the operation of a draw frame with a plurality of cascaded roller pairs following one another in a direction of travel of sliver to be combined into an outgoing bundle, said roller pairs being rotated at relative speeds imparting tension to the bundle between the portion clamped in the nips of each pair of rollers, wherein the improvement comprises the steps of:

(a) sensing thickness fluctuations of said bundle;
(b) successively varying the nip line spacing between roller pairs;
(c) for each nip line spacing thus established, maintaining the nip line spacing constant and measuring the extent of said fluctuations;
(d) ascertaining the nip line spacing for which said fluctuations as measured in step (c) are at a minimum; and
(e) maintaining the nip line spacing as the ascertained value of step (d) for continued operation of the draw frame.

2. The method defined in claim 1 wherein steps (a) through (d) inclusive are carried out in a programmed manner during an initial phase of a fiber-drawing operation to establish the optimum value of said nip line spacing which is thereafter maintained.

3. A method of controlling the operation of a draw frame with a plurality of cascaded roller pairs following one another in a direction of travel of incoming fibers to be combined into an outgoing bundle, said roller pairs being rotated at relative speed imparting a tensile stress to fibers clamped under compressive stress between the rollers of each pair, wherein the improvement comprises the steps of:

(a) sensing thickness fluctuations of said outgoing bundle downstream of said roller pairs;
(b) periodically varying the compressive stress applied by the rollers of said pairs to said fibers;
(c) measuring the fluctuations in said thickness resulting from said periodic variation of the compressive stress; and
(d) establishing the compressive stress applied by each of said rollers at a value which minimizes said fluctuations.

* * * * *